US010301730B2

(12) United States Patent
Mojana et al.

(10) Patent No.: US 10,301,730 B2
(45) Date of Patent: May 28, 2019

(54) ELECTRODIC APPARATUS FOR THE ELECTRODEPOSITION OF NON-FERROUS METALS

(71) Applicant: INDUSTRIE DE NORA S.P.A., Milan (IT)

(72) Inventors: Corrado Mojana, Milan (IT); Luciano Iacopetti, Milan (IT); Andrea Gozzo, Milan (IT); Roberto Pagano, Milan (IT)

(73) Assignee: INDUSTRIE DE NORA S.P.A., Milan (IT)

( * ) Notice: Subject to any disclaimer, the term of this patent is extended or adjusted under 35 U.S.C. 154(b) by 0 days.

(21) Appl. No.: 15/738,829

(22) PCT Filed: Jul. 22, 2016

(86) PCT No.: PCT/EP2016/067493
§ 371 (c)(1),
(2) Date: Dec. 21, 2017

(87) PCT Pub. No.: WO2017/016998
PCT Pub. Date: Feb. 2, 2017

(65) Prior Publication Data

US 2018/0179651 A1 Jun. 28, 2018

(30) Foreign Application Priority Data

Jul. 24, 2015 (IT) ..... 102015000037944

(51) Int. Cl.
*C25C 7/04* (2006.01)
*C25C 1/12* (2006.01)
(Continued)

(52) U.S. Cl.
CPC ..... *C25C 7/04* (2013.01); *C25C 1/00* (2013.01); *C25C 1/12* (2013.01); *C25C 7/00* (2013.01); *C25C 7/02* (2013.01)

(58) Field of Classification Search
None
See application file for complete search history.

(56) References Cited

U.S. PATENT DOCUMENTS 3,029,193 A * 4/1962 Dean ..... C25C 3/26 204/246
4,201,653 A * 5/1980 O'Neill ..... C25C 7/00 204/263

(Continued)

FOREIGN PATENT DOCUMENTS

WO 2007/071713 A1 6/2007
WO 2007/071714 A1 6/2007

(Continued)

OTHER PUBLICATIONS

International Search Report and Written Opinion for International Application No. PCT/EP2016/067493 (dated Oct. 21, 2016) (8 Pages).

(Continued)

*Primary Examiner* — Harry D Wilkins, III
(74) *Attorney, Agent, or Firm* — Lucas & Mercanti, LLP

(57) ABSTRACT

This invention relates to electrodic apparatus suitable for the electrodeposition of nonferrous metals, for example for the electrolytic production of copper and other nonferrous metals from solutions of ions, comprising an electrode and at least one ionpermeable screen intended for protection of the said electrode.

15 Claims, 1 Drawing Sheet

(51) Int. Cl.

| | |
|---|---|
| ***C25C 7/02*** | (2006.01) |
| ***C25C 1/00*** | (2006.01) |
| ***C25C 7/00*** | (2006.01) |

(56) References Cited

U.S. PATENT DOCUMENTS

| | | | | | |
|---|---|---|---|---|---|
| 4,448,838 | A * | 5/1984 | McClenahan | B29C 70/08 | 428/408 |
| 5,071,699 | A * | 12/1991 | Pappas | B65D 88/165 | 383/108 |
| 5,478,154 | A * | 12/1995 | Pappas | B32B 23/10 | 383/105 |
| 5,679,240 | A * | 10/1997 | Anastasijevic | C25C 7/02 | 204/269 |
| 2005/0067291 | A1* | 3/2005 | Haiki | C25C 1/12 | 205/111 |
| 2014/0246306 | A1* | 9/2014 | Faita | C25C 7/00 | 204/252 |
| 2015/0171398 | A1 | 6/2015 | Roumi | | |
| 2016/0024670 | A1* | 1/2016 | Fiorucci | C25C 7/00 | 205/576 |

FOREIGN PATENT DOCUMENTS

| | | | | |
|---|---|---|---|---|
| WO | WO2013/060786 | A1 * | 5/2013 | C25C 7/00 |
| WO | 2014/161929 | A1 | 10/2014 | |

OTHER PUBLICATIONS

International Preliminary Report on Patentability for International Application No. PCT/EP2016/067493 (dated Jul. 31, 2017) (12 Pages).

* cited by examiner

ELECTRODIC APPARATUS FOR THE ELECTRODEPOSITION OF NON-FERROUS METALS

This application is a U.S. national stage of PCT/EP2016/067493 filed on Jul. 22, 2016 which claims the benefit of priority from Italian Patent Application No. 102015000037944 filed Jul. 24, 2015 the contents of each of which are incorporated herein by reference.

SCOPE OF THE INVENTION

This invention relates to electrodic apparatus for electrolysis cells intended for facilities for electrorefining, electroplating or the electrolytic extraction of non-ferrous metals.

BACKGROUND TO THE INVENTION

Electrodeposition facilities, in particular facilities intended for the electrolytic extraction of non-ferrous metals, typically use at least one electrolysis cell comprising a plurality of unit cells each of which comprises an anode and a cathode, generally located in the electrolysis bath in an alternating and mutually parallel position.

In the case of facilities for the electrolytic extraction of non-ferrous metals such as copper, cobalt, zinc or nickel, the metal is deposited as the electrical current passes through the cathode of each unit cell and the metal is collected at periodical intervals by removing the cathodes from their seats. In the situations described above deposition of the metal may take place non-uniformly and give rise to dendritic formations, that is localised deposits which grow towards the opposite anode at an increasing rate with the passage of electrical current, ultimately coming into direct electrical contact with the latter. In this case the short circuit produced between the electrodes can draw current off from the other electrolysis cells, reducing the quality and quantity of the metal produced, and give rise to a local increase in the anode temperature which can cause it to be damaged. In modern anodes made of grids or stretched sheets of titanium, or other valve metal, these undesirable effects can give rise to extensive irreversible damage.

In general damage to the anodes involves greater maintenance costs for the plant, a lesser quantity of metal produced and possible further damage associated with forced shutdown of the system.

It has been observed that in typical facilities for the electrolytic extraction of non-ferrous metals short circuits caused by dendrites are typically concentrated during the period of time corresponding to the last 25-30% of the length of each collection cycle, depending upon the operating conditions in the facility. In medium-sized electrolytic facilities for the extraction of copper operating at a current density of approximately 400-460 A, for example, short circuits caused by dendrites typically occur during the last 20-24 hours of each cycle of average length 4-5 days.

The use of an anode enclosure comprising a permeable material, for example a porous separator of polymer material or an ion-conducting membrane, as described in application WO2013060786, is ineffective in blocking or slowing the growth of dendrites for sufficient time to reduce the number of actions which have to be taken by operators in the event of electrical contact and limit their urgency.

The inventors have observed that the use of a protective screen of conductive material placed so as to protect the anode can slow down the growth of dendrites for an average period of approximately 8-10 hours, but if there is contact with the dendritic formation damage to the anode is generally non-negligible because of high current transport through the conducting screen. Furthermore, on contact with the dendrite, the conductive screen reaches the cathode potential and tends to be coated with metal. The inventors have observed that metal deposited on the screen is not fully dissolved when the cell is restarted after collection operations, but on the side facing the anode can detach as fragments, which may even be large, that are capable of causing further short circuits with the anode when the plant is restarted, damaging it as a consequence.

The need for a system capable of blocking or in any event delaying the growth of dendritic formations in the direction of the opposite electrode for a sufficient number of hours to minimise the number and urgency of actions by the personnel operating a facility has therefore been reviewed. In particular it is felt that during night-time shifts it may happen that operators are not present in sufficient numbers to ensure that action is taken in good time in the event of a short circuit between electrodes. In addition to this, the facility may not be provided with cell current monitoring systems capable of indicating the presence of abnormalities in current distribution quickly and accurately. A system capable of retarding the growth of dendritic formations for a period of at least 12 hours, preferably at least 18-24 hours, is therefore desirable.

It is also desirable that whenever a short-circuit situation should become established between the electrodes of a unit cell through contact via a dendritic formation, the damage caused to the electrodes will be such as to keep the electrode in question functioning and not have an adverse effect on the quantity and quality of production, thus helping to reduce maintenance costs for the facility.

SUMMARY OF THE INVENTION

In one aspect the invention relates to electrode apparatus for the electrodeposition of non-ferrous metals comprising an electrode capable of evolving oxygen and at least one ion-permeable screen located parallel to the said electrode, where the said screen comprises at least one structure of electrically non-conducting material provided with a plurality of electrically conducting materials spaced apart from each other.

By the term "electrically conducting segment" is meant an element which as a result of its geometrical or physical characteristics is capable of conducting electrical current, preferably along a predefined direction. The segments constitute separate units within the structure, in that they are not placed in direct contact with each other.

Each electrically conducting segment may comprise a plurality of conducting elements which may also be intercalated or intimately connected with non-conducting elements. In one embodiment the electrically conducting segments are located in a direction substantially parallel to each other, that is on average the direction of each segment may form an angle of not more than 15° with the adjacent segments (local deviations of the constituent elements of the segments, or parts thereof, though angles of more than 15° may however be accepted).

The plurality of segregated conducting segments imparts unidirectional microscopic electrical conductivity upon the ion-permeable screen in the plane of the screen. By the term "unidirectional" is meant herein and below that the macroscopic electrical conductivity of the screen is on average within its plane, of at least a greater order of magnitude along a preselected direction than in a direction perpendicular thereto. Preferably the macroscopic electrical conductivity of the screen is on average at least two orders of magnitude greater along a preselected direction.

The structure of the electrically non-conducting material is capable of mechanically supporting the plurality of electrically conducting segments.

It is to be understood that the ion-permeable screen may comprise further conducting elements, also in electrical contact with the electrically conducting segments described above, provided that the average macroscopic electrical conductivity of the screen remains unidirectional (in the meaning of the definition above) within its plane.

By the term "ion-permeable screen" is meant a screen capable of ion transport. The presence of this screen should not in fact constitute an appreciable obstacle to the electrochemical reaction which takes place in the unit cell housing the electrode apparatus according to the invention. When the latter is inserted into an electrolysis cell for the electrolytic extraction of copper it may be advantageous for the screen to have an ohmic drop, measured at a current density of approximately 450 $A/m^2$, which is less than 30 mV, preferably less than 20 mV. The electrode apparatus according to the invention may for example be used for the electrolytic extraction of copper, cobalt, zinc or nickel; in this case the electrode according to the invention is an anode. This may be manufactured from a plurality of materials and in a plurality of geometries that allow oxygen to be evolved during the electrochemical reaction; the anode for example may be a sheet of lead or a stretched grid of valve metal, such as titanium, which may optionally be catalytically activated.

The presence of the ion-permeable screen in the anode apparatus described above may provide the advantage of retarding the growth of dendrites from the cathode in the direction of the opposite anode by at least 12 hours from contact with the screen. The said screen may also provide the advantage of breaking up the dendrite with which it comes into contact into secondary dendritic formations of smaller size along a preselected direction, coinciding with the direction of maximum average electrical conductivity of the screen. This may make it possible to reduce the damage occurring to the electrode in the case of a short circuit, limiting its extension to areas of surface area of $2.5\times2.5$ $cm^2$ or less. It has been observed that in general damage of such dimensions does not appreciably adversely affect the quality and quantity of metal deposition onto the surface of the opposing cathode.

The inventors have observed that dendrites which come into contact with the protective screen according to the invention generally stop growth in the direction of the opposite electrode for some time, preferably growing along the segment or segments of the screen which they have intercepted. Growth of the dendrites in a direction perpendicular to the segments in the plane of the screen is generally small, given their segregated nature. Growth of the dendrite along a predetermined direction may delay the growth of metal formation in the direction of the opposing anode by at least 12 hours. It has also been observed that after contact with the screen and growth along the segments the dendrites continue to grow towards the opposing electrode in a typically subdivided manner, from different points of the segment or segments over which the primary dendritic formation has extended. When they come into contact with the opposing electrode these smaller or secondary dendrites in general produce surface damage of a negligible nature during the times occurring between contact and removal of the cathodes for collection operations.

In one embodiment the non-conducting structure is a porous or perforated material. This embodiment may have the advantage of encouraging ion transport across the structure, and therefore across the screen, and ensuring that the oxygen bubbles developed at the electrode of the electrode apparatus according to the invention circulate.

In another embodiment the structure of the ion-permeable screen is made of fabric or non-woven fabric using electrically non-conducting materials. These materials may be non-conducting polymers, for example thermoplastic polymers such as polyester, polypropylene, nylon, polyethylene, polyparaphenylene sulphide, or combinations thereof. The fabrics and non-woven fabrics may have the advantage that they ensure suitable structural support for the conducting segments, thus keeping costs of production and materials low. The use of non-conducting polymers may offer a further advantage in terms of costs, ensuring adequate chemical/physical strength to resist the corrosive environment in the electrolysis cells. It may be advantageous for the screen according to this embodiment to have a mechanical tensile strength of at least 400 N/m, preferably at least 600 N/m, so that it can stretch adequately within the cell and avoid relaxation. With this object the fabric/non-woven fabric structure may be provided with reinforcing and/or supporting elements, for example a set of springs or other resilient devices connected thereto.

In a further embodiment each electrical conducting segment comprises a material selected from the group comprising valve metals, noble metals, iron, nickel, chromium and their alloys and combinations, conductive carbons and graphite. These materials may be applied in such a way as to ensure greater mechanical strength for the segments, in particular in the case where graphite segments are used.

Each segment may constitute, wholly or in part, at least one yarn, wire, string, strip, filament, fibre, tape or ribbon or combinations thereof, and each segment is applied to the structure of the electrode apparatus according to the invention in such a way as to be intimately connected therewith. For example the said at least one yarn, wire, string, strip, filament, fibre, tape or ribbon or combinations thereof may be inserted into, placed over, incorporated in, poured over, woven, sewn, embedded or worked into the said structure.

The term "yarn" below is used interchangeably with the terms filament, fibre and wire, and comprises elements similar to or deriving therefrom, such as for example tapes and ribbons.

In a further embodiment the ion-permeable screen is a textile screen, or a textile comprising a warp and a weft. The fabric is made of yarns of non-conducting, optionally polymer, materials, in both the warp and the weft, intercalated with conducting materials in the direction of the warp or, alternately, the weft, in accordance with a predetermined scheme. The yarns of non-conducting material may be of different material and/or colour for the warp and the weft. The difference in colour may assist correct orientation of the screen in the electrolytic cell by operators when the electrode apparatus is being installed.

The fabric may for example comprise a warp of yarns of non-conducting, optionally polymer, material and a weft comprising a first predetermined number of non-conducting optionally polymer yarns intercalated with a second predetermined number of conducting yarns. In one embodiment the first predetermined number is selected between 1 and 20, preferably 2 and 8, and the second predetermined number is selected between 1 and 20, preferably 4 and 10.

Alternatively the fabric may be manufactured in such a way as to be electrically conducting in the direction of the warp. For example the warp may comprise an alternation of yarns of non-conducting material with yarns of conducting material and the weft may be made of yarns of non-conductive material.

The textile screen may be mounted in a vertical cell with unidirectional conducting elements orientated in any direction, preferably a horizontal one.

The wires of conductive material may be made of valve metal, noble metals, iron, nickel, chromium and their alloys and combinations, conducting carbons or graphite. For example the wires may be made of stainless steel or titanium and/or have a diameter of 0.02-0.20 mm, preferably 0.03-0.06 mm. They may be located parallel to each other or twisted on themselves and/or on at least one yarn of non-conducting material.

The yarns of non-conducting material may be made of a non-conducting thermoplastic polymer material for example polyester, polypropylene, nylon, polyethylene, polyparaphenylene sulphide or combinations thereof.

In a further embodiment of the invention the textile screen will have a unit weight of 50-600 g/m$^2$, preferably 100-300 g/m$^2$ and/or a number of yarns per centimeter of 8-200, preferably 10-100.

The embodiments of the textile screen described above may have the advantage of offering low production, raw materials and transport costs, and may make it possible to delay the growth of dendritic formations in the direction of the opposing electrode by at least 14 hours, typically at least 18-24 hours, from contact with the screen. The presence of yarns of non-conducting material in both the warp and the weft may impart greater mechanical and structural strength to the screen. The mesh of the fabric may favour the passage of ions from the electrolyte solution through the screen and possible circulation of oxygen bubbles generated at the electrode.

In a further embodiment the textile screen is provided with a selvedge comprising wires of electrically conducting material, either wholly or in part. If the conducting segments are located in the direction of the weft and mounted horizontally in a vertical cell, this embodiment may offer the advantage of providing the screen with means for electrical connection with the segments for the purpose of measuring and monitoring current parameters in the screen. It may be desirable to wind or coat the conductive selvedge with an insulating material so as to prevent direct contact between any dendritic formations and the conductive selvedge, and thus prevent the growth of any dendrites along the selvedge, in particular in the situation where this is at right angles to the segments.

In a further embodiment at least one edge of the screen is covered with an insulating composite material. The latter may comprise a covering ribbon and an insert of polyacrylic material, where the insert is placed between the screen and the covering ribbon. Because the edge of the screen constitutes an element of electrical discontinuity, the composite element may help to prevent the growth of secondary dendritic formations along the sides of the screen.

The electrode apparatus according to the invention may be subdivided into at least two portions which are electrically insulated from each other.

The electrode apparatus according to the invention may also be provided with a perforated separator of electrically insulating material placed between the electrode and the screen. The separator may help to prevent accidental contact between the screen and electrode and may be profiled in such a way as to assist the evolution of oxygen. For example the separator may be a grid of a few millimeters' thickness, 2-5 mm, of insulating material that is resistant to corrosion (for example polyester, polypropylene, nylon, polyethylene, polyparaphenylene sulphide or combinations thereof). The openings in the grid may have dimensions of between 0.5 cm×0.5 cm and 2 cm×2 cm and may be of square or rectangular shape with an inclination of 20°-70° with respect to the vertical (for example 45°) to assist the evolution of oxygen.

According to a further aspect the invention relates to an electrolytic cell for the electrolytic extraction of non-ferrous metals comprising a plurality of intercalated anodes and cathodes, where at least one of the said anodes is an electrode apparatus according to any of the embodiments described above.

According to a further aspect this invention relates to a protective screen for the electrode of an electrolysis cell for the electrodeposition of non-ferrous metals, where the said screen is ion-permeable and provided with at least one structural element of electrically insulating material provided with a plurality of electrically conducting segments located at a mutual distance from each other.

DETAILED DESCRIPTION OF THE DRAWINGS

Figure 1:
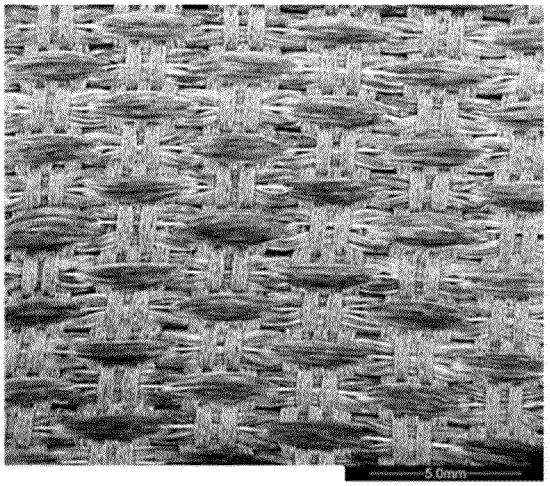
FIG. 1 shows an image of the ion-permeable screen according to one embodiment of the invention (×7 magnification) obtained using a scanning electron microscope (SEM).

FIG. 1 shows a SEM image of a textile ion-permeable screen according to one embodiment of the invention, in which the textile is manufactured using a warp comprising polyester fibre. The weft comprises the intercalation of 4 polypropylene wefts with one weft of AISI 316 stainless steel comprising a set of 8 stainless steel wires of 0.035 mm onto which a wire of 0.035 mm AISI 316 stainless steel is twisted. The image of the sample was acquired using a scanning electron microscope with an Everhart-Thornley detection system, ×7 magnification (working distance 61.5 mm, accelerating voltage 500.0 V).

Figure 2:
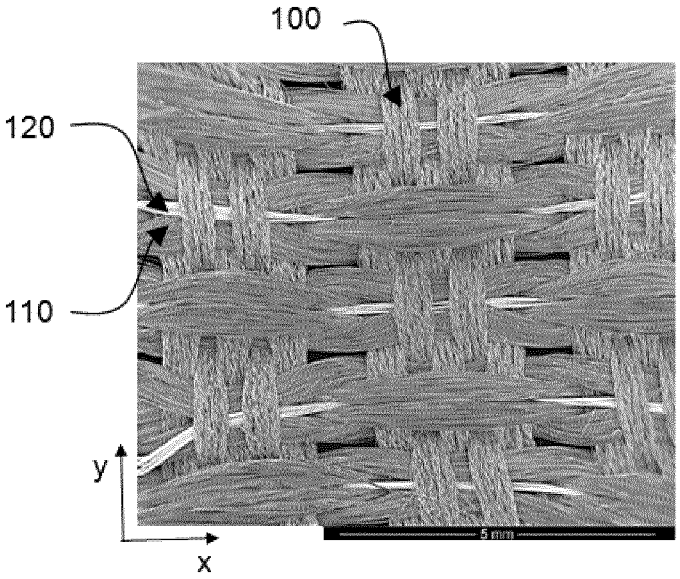
FIG. 2 is an image of the ion-permeable screen in FIG. 1, with ×35 magnification, acquired using a field emission scanning electron microscope (SEM-FEG).

FIG. 2 shows a SEM-FEG image of the textile ion-permeable screen in FIG. 1 with ×35 magnification (working distance 25.0 mm, accelerating voltage 1.0 kV, Everhart-Thornley detection system). The polyester warp fibres (100) and the polypropylene fibres (110) intercalated with the assembly of twisted stainless steel wires (120) constituting the weft can be seen in the xy plane. The wires (120) comprise the electrically conducting segments of the screen according to the invention. This imparts upon the latter a macroscopic electrical conductivity which is substantially limited to the x direction, and therefore characterised by a specific unidirectionality in the plane of the screen.

The examples below are included to demonstrate particular embodiments of the invention, the implementability of which has been abundantly checked throughout the range of values claimed. Those skilled in the art will appreciate that the compositions and techniques described in Example 1 represent compositions and techniques which the inventors have found to work well in practical embodiments of the invention; however, in the light of this description those skilled in the art must appreciate that many changes may be made to the specific embodiments disclosed while still obtaining a similar or analogous result without going beyond the scope of the invention.

EXAMPLES

In the examples and comparison examples described below laboratory tests have been performed in an experimental cell for the electrolytic extraction of copper having an overall transverse cross-section of 170 mm×170 mm and a height of 1500 mm, containing two cathodes separated by an anode. The cathodes and the anode were located parallel to each other and faced each other vertically at a distance of 40 mm apart between the outer surfaces. A sheet of 3 mm thick, 120 mm wide and 1000 mm high AISI 316 stainless steel was used for the cathodes; the anode comprised a stretched grid of titanium of thickness 1 mm, width 120 mm and height 1000 mm, activated with a coating of mixed iridium and tantalum oxides.

The cell was provided with a programmable logic control system governing the process parameters (temperature, throughput, voltage and electrical current), with excess temperature and excess current alarms. The cell was also provided with a data acquisition and recording system for the analysis of process parameters measured over time.

The cell operated using an electrolyte containing approximately 61 g/l of copper as $Cu_2SO_4$ and 210 g/l of $H_2SO_4$ and was fed with a constant potential difference of 1,800 V corresponding to an expected current density of approximately 455 A/m$^2$ (110 A). Oxygen was evolved at the anode and copper was deposited at the cathode.

A dendrite was artificially produced by inserting a screw, as a centre for nucleation, into one of the two cathodes, perpendicularly thereto and in the direction of the anode. The tip of the screw was positioned 10 mm from the anode.

Example 1

A textile ion-permeable screen according to an embodiment of the invention comprising a warp of polyether sulfone (PES) fibres and a weft comprising a sequence of 4 PES fibres intercalated with 8 AISI 316 stainless steel wires of diameter 0.05 mm was placed in the cell described above at a distance of 5 mm from each surface of the anode and parallel thereto. The conducting elements were assembled by twisting one of the steel wires over the remaining 7 wires arranged in parallel to each other. The fabric was characterised by a yarn per cm number of 20 and a unit weight of 220 g/m$^2$.

A polyethylene separator 4 mm thick, provided with square holes of size 1.5 cm orientated at 45° with respect to the vertical, was placed between the screen and the anode.

The cell was operated under the electrolysis conditions described above and in the course of operation it was possible to establish, by observing the growth of gas bubbles, that the anode reaction was taking place selectively on the anode surface and not on the screen in front of it.

It was also observed that the dendrite growing in the direction of the anode came into contact with the screen after approximately 6 hours. After 21 hours from this primary contact the data acquisition system recorded a current peak of 250 A lasting a few seconds, indicating a secondary short circuit caused by contact between a secondary dendrite and the anode. A further peak of 500 A lasting a few seconds was observed after 10 minutes, followed by an alternation of current peaks of between 170 and 190 A during the subsequent 10 minutes. This behaviour of the current was repeated for the subsequent 40 minutes, as recorded by the data acquisition system.

At the end of the test the cathodes were removed from the experimental cell and the primary dendrite was detached from the protective screen without damaging it.

The experimental cell was then dismantled and from a visual inspection it could be observed that: 1) the screen was structurally intact, 2) diffusion of copper onto the screen was confined to a small set of adjacent metal wires. Globular growth of copper of limited size, with the exception of two secondary dendritic points of diameter 2 and 3 mm respectively which touched the anode at 2 points, were also observed on the anode side of the screen, corresponding to conductive wires in contact with the primary dendrite (and those immediately adjacent thereto). At the contact points the anode showed extremely localised damage (less than 1 and 1.5 cm$^2$) which was not prejudicial to its subsequent functioning.

On completion of the visual inspection the cathodes were reinserted in their seats and the cell was again placed in operation for a period of 4 hours. During this period of time it was observed that copper dissolved from the protective screen primarily on the side facing the cathode. The copper deposited on the screen in the direction of the anode partly dissolved. The residual copper became detached, and deposited on the base of the cell in fragments of small size.

Comparative Example 1

In the cell described above, a textile ion-permeable screen made using a warp and a weft of polyester fibre was positioned in the cell described above at a distance of 5 mm from each surface of the anode and parallel thereto. The fabric was characterised by a number of yarns per cm of 18 and a unit weight of 150 g/m$^2$.

A polyethylene separator of 4 mm thickness provided with square openings of size 1.5 cm orientated at 45° with respect to the vertical was placed between the screen and the anode.

The cell was placed in operation under the electrolysis conditions described above and during operation it was possible to verify by observing the growth of gas bubbles that the anode reaction was taking place selectively at the surface of the anode and not on the screen in front of it.

It was also observed that the dendrite grew in the direction of the anode and came into contact with the screen after approximately 6 hours. After approximately one hour the data acquisition system recorded a current peak of over 500 A, which was repeated at intervals of a few seconds for the next 10 minutes.

At the end of the test the cathodes were removed from the experimental cell and the primary dendrite was detached from the protective screen without damaging it.

The experimental cell was then dismantled and from a visual inspection it was possible to observe that 1) the screen was structurally intact, 2) diffusion of copper on the screen was limited to a small area corresponding to the contact, 3) only one secondary dendritic formation of diameter approximately 10 mm had grown at the point of contact between the primary dendrite and the screen and had reached the anode causing extensive damage to it. The damage to the anode surface affected an area of approximately 4 cm×6 cm, prejudicing subsequent use of the electrode.

Comparative Example 2

A screen comprising a grid of titanium comprising wires of 1 mm diameter was positioned in the cell described above at a distance of 5 mm from each surface of the anode and parallel thereto.

A polyethylene separator of 4 mm thickness provided with square openings of side 1.5 cm orientated at 45° with respect to the vertical was placed between the screen and the anode.

The cell was placed in operation under the electrolysis conditions described above and during operation it was possible to verify by observing the growth of gas bubbles that the anodic reaction was taking place selectively on the surface of the anode and not on the screen in front of it.

It was also observed that the dendrite grew in the direction of the anode and came into contact with the screen after approximately 6 hours. 10 hours after this primary contact the data acquisition system recorded a current peak of 300 A, followed by a peak of 500 A which was recorded at intervals a few seconds apart for the next 5 minutes.

At the end of the test the cathodes were removed from the experimental cell and the primary dendrite was removed from the protective screen without damaging it.

The experimental cell was then dismantled and from a visual inspection it was possible to observe that 1) the screen was structurally intact and completely covered with copper, on both the cathode side and the anode side. The growth of a dendritic point of mean diameter 12 mm which touched the anode at 1 point was also observed on the anode side of the screen, at the contact with the primary dendrite. At the point of contact the anode suffered damage of area 6 cm×8 cm which prejudiced its subsequent functioning.

At the end of the visual inspection the cathodes were reinserted into their seats and the cell was again placed in operation for a period of 4 hours, after the damaged anode had been replaced. During this period of time it was observed that copper dissolved from the protective screen first on the side facing the cathode. The copper deposited on the screen in the direction of the anode partly dissolved and partly detached in fragments of different size, some of more than 1 $cm^2$. Some fragments remained embedded between the screen and the anode, creating a direct electrical contact between them and compromising the protective function of the screen in the event of subsequent contact with dendritic formations originating from the cathode.

The above description is not intended to limit the invention, which may be used in various embodiments without thereby departing from its objects and its scope is unequivocally defined by the appended claims.

In the description and claims of this application the word "comprises" and its variations such as "comprising" and "comprise" do not rule out the presence of other additional elements, components or process stages.

The discussion of documents, actions, materials, apparatus, articles and the like is included in the text solely for the purpose of providing a context for this invention; it should not however be understood that this material or part thereof constitutes general knowledge in the field relating to the invention prior to the priority date of each of the claims appended to this application.

The invention claimed is:

1. An electrode apparatus for electrodeposition of non-ferrous metals, comprising:

an electrode suitable for oxygen evolution; and at least one ion-permeable screen arranged parallel to said electrode, wherein said ion-permeable screen is a structure of non-electrically conductive material comprising a multiplicity of segregated electrically conductive segments intercalated and intimately connected with the non-electrically conductive material, the electrically conductive segments imparting unidirectional electrical conductivity upon the ion-permeable screen.

2. The electrode apparatus according to claim 1, wherein said structure is porous or foraminous.

3. The electrode apparatus according to claim 2, wherein said structure is a cloth or a non-woven cloth, optionally made of not conductive polymer material.

4. The electrode apparatus according to claim 1, wherein said electrically conductive segments comprise a material selected from the group consisting of valve metals, noble metals, iron, nickel, chromium and alloys and combinations thereof, conductive carbons and graphite.

5. The electrode apparatus according to claim 1, wherein said electrically conductive segments comprise at least one element selected from the group consisting of yarns, wires, strings, strips, bands, tapes and ribbons, applied to said structure.

6. The electrode apparatus according to claim 1, wherein said at least one screen is a cloth comprising:

a warp of yarns of optionally polymeric non-conductive material;

a weft comprising a first predefined number of optionally polymeric non-conductive yarns intercalated with a second predefined number of conductive yarns.

7. The electrode apparatus according to claim 6, wherein said yarns of conductive material have a diameter of 0.02-0.20 mm, said first and said second predefined number being independently selected in the range 1-20.

8. The electrode apparatus according to claim 6, wherein said yarns of conductive material are arranged parallel to each other or twisted either on themselves or around at least one yarn of non-conductive material.

9. The electrode apparatus according to claim 6, wherein said cloth has a unit weight of 50-600 $g/m^2$.

10. The electrode apparatus according to claim 6, wherein said yarns amount to 8-200 yarns per centimeter.

11. The electrode apparatus according to claim 6, wherein said cloth is equipped with a selvage wholly or partially consisting of yarns of electrically conductive material.

12. The electrode apparatus according to claim 1, wherein at least one edge of said screen is covered by a composite insulating element, optionally comprising a cover ribbon and an insert of polyacrylic material, said insert being interposed between said screen and said cover ribbon.

13. The electrode apparatus according to claim 1, wherein said screen is subdivided into at least two portions electrically insulated from each other.

14. The electrode apparatus according to claim 1, further comprising a foraminous separator of electrically insulating material interposed between said electrode and said at least one screen.

15. An electrolyser for electrowinning of non-ferrous metals comprising a multiplicity of interleaved anodes and cathodes, wherein at least one of said anodes is the electrode apparatus according to claim 1.

* * * * *